US009596968B2

(12) United States Patent
Stein

(10) Patent No.: US 9,596,968 B2
(45) Date of Patent: Mar. 21, 2017

(54) FLOOR CARE APPLIANCE

(71) Applicant: Stein & Co. GmbH, Velbert (DE)

(72) Inventor: Thomas Stein, Velbert (DE)

(73) Assignee: Stein & Co. GmbH, Velbert (DE)

( * ) Notice: Subject to any disclaimer, the term of this patent is extended or adjusted under 35 U.S.C. 154(b) by 122 days.

(21) Appl. No.: 14/704,005

(22) Filed: May 5, 2015

(65) Prior Publication Data

US 2015/0313428 A1 Nov. 5, 2015

(30) Foreign Application Priority Data

May 5, 2014 (DE) ..... 10 2014 006 979
Jun. 6, 2014 (DE) ..... 10 2014 008 442

(51) Int. Cl.

| | |
|---|---|
| ***A47L 5/30*** | (2006.01) |
| ***A47L 9/04*** | (2006.01) |
| ***A47L 9/24*** | (2006.01) |
| ***A47L 9/28*** | (2006.01) |
| ***A47L 9/02*** | (2006.01) |

(52) U.S. Cl.

CPC ..... *A47L 9/0411* (2013.01); *A47L 5/30* (2013.01); *A47L 9/02* (2013.01); *A47L 9/0477* (2013.01); *A47L 9/246* (2013.01); *A47L 9/248* (2013.01); *A47L 9/2857* (2013.01)

(58) Field of Classification Search

CPC .... A47L 9/2889; A47L 9/0411; A47L 9/0444; A47L 9/2857; A47L 9/0477

See application file for complete search history.

(56) References Cited

U.S. PATENT DOCUMENTS

| | | | |
|---|---|---|---|
| 5,228,169 | A | 7/1993 | Stein |
| 2010/0024156 | A1 | 2/2010 | De Soto-Burt et al. |

FOREIGN PATENT DOCUMENTS

| | | |
|---|---|---|
| DE | 9104750 | 6/1991 |
| DE | 112009001873 | 7/2011 |
| GB | 252414 | 11/1926 |

OTHER PUBLICATIONS

German Search Report, Jun. 6, 2014.

*Primary Examiner* — David Redding

(74) *Attorney, Agent, or Firm* — Greer, Burns & Crain Ltd.

(57) ABSTRACT

A brush vacuum cleaner having a brush set facing the floor with a driven brush roller, wherein the brush set can be connected via a pivotable connecting element in the form of a connecting piece for a filter housing attachable to a handle having a hand grip. The brush set accommodates an electric motor for a suction fan and for the drive of the brush roller. An electrical switch is provided for switching the electric motor on and off which is disposed on the side wall as a lateral flank of the brush set in the form of a foot operated switch. The switch with its external control surface projects outwards with respect to the side wall in the switched-off position whereas in the switched-on position the control surface ends with neighboring or adjacent surface sections of the side wall without overhang.

5 Claims, 3 Drawing Sheets

FLOOR CARE APPLIANCE

CROSS-REFERENCES TO RELATED APPLICATIONS

This application claims the benefit of the German patent application No. 10 2014 008 442.6 filed on Jun. 6, 2014, and of the German patent application No. 10 2014 006 979.6 filed on May 5, 2014, the entire disclosures of which are incorporated herein by way of reference.

BACKGROUND OF THE INVENTION

The invention relates to a floor care appliance in the form of a brush vacuum cleaner having a brush set facing the floor for receiving a driven brush roller, where the brush set can be connected by means of a pivotable connecting element in the form of a connecting piece for an attachable filter housing to a handle in the form of a hand grip via corresponding connections and the brush set accommodates at least one electric motor for a suction fan and for the drive of the brush roller and has a switch for switching on and off.

It has been found that the operation of switches of these appliances frequently leads to damage. It is known to provide switches for foot operation for switching on and off on the upper side of cylinder vacuum cleaners. When the switches are arranged on the upper side of brush sets which have a relatively low overall height, damage to and breaking of the housing frequently occurs with this arrangement on the upper side since the operator rests with his entire body weight on the brush set when operating the switch. Documentary prior art is known from DE 11 2009 001 873 T5, DE 91 04 750 U1 and GB 252 414 A.

SUMMARY OF THE INVENTION

An object of the invention is to provide an arrangement of a switch for generic brush vacuum cleaners which enables damage-free execution of the switching processes on the brush set and avoids impairment by hooking of the switch during the cleaning process.

The solution of this object is accomplished according to the invention whereby the control surface for actuation of the switch is disposed on the side wall as a lateral flank of the brush set for foot operation, where the external control surface projects with respect to the side wall of the brush set in the switched-off position and in the switched-on position ends detachably via latching elements with the side wall without any overhang.

As a result, it is not possible to damage the brush set during operation of the switch. As a result of the integration of the switch in the side wall without overhang of the control surface during the switching-on process any damage due to hooking is avoided and a so-called push-to-open is made possible to execute a switch-off process.

An advantageous embodiment consists in that the control surface of the switch is configured as a hinged lever surface which in the switched-off position projects at an angle with respect to the side wall of the brush set and in the switched-on position is positioned in the surface of the side wall without overhang and is held by means of a detachable latching element.

Alternatively it is proposed that the switch is configured as a pressure switch whose control surface in the switched-on position is positioned in the surface of the side wall without overhang and in the switched-off position projects from the surface of the side wall.

It is further provided that the control surface of the switch in the switched-on position is arranged flat in the surface of the side wall. "Without overhang" therefore means in particular that the control surface in the switched-on position does not project beyond the side wall. "Without overhang" can therefore mean both a setting back of the control surface with respect to neighbouring or adjacent surface sections of the side wall in the switched-on position and also in another embodiment can mean a flat termination.

It is further proposed that the switch is disposed on the left side of the brush set relative to the working direction.

BRIEF DESCRIPTION OF THE DRAWINGS

An exemplary embodiment of the invention is shown schematically in the drawings. In the figures.

DETAILED DESCRIPTION OF THE PREFERRED EMBODIMENTS

Figure 1:
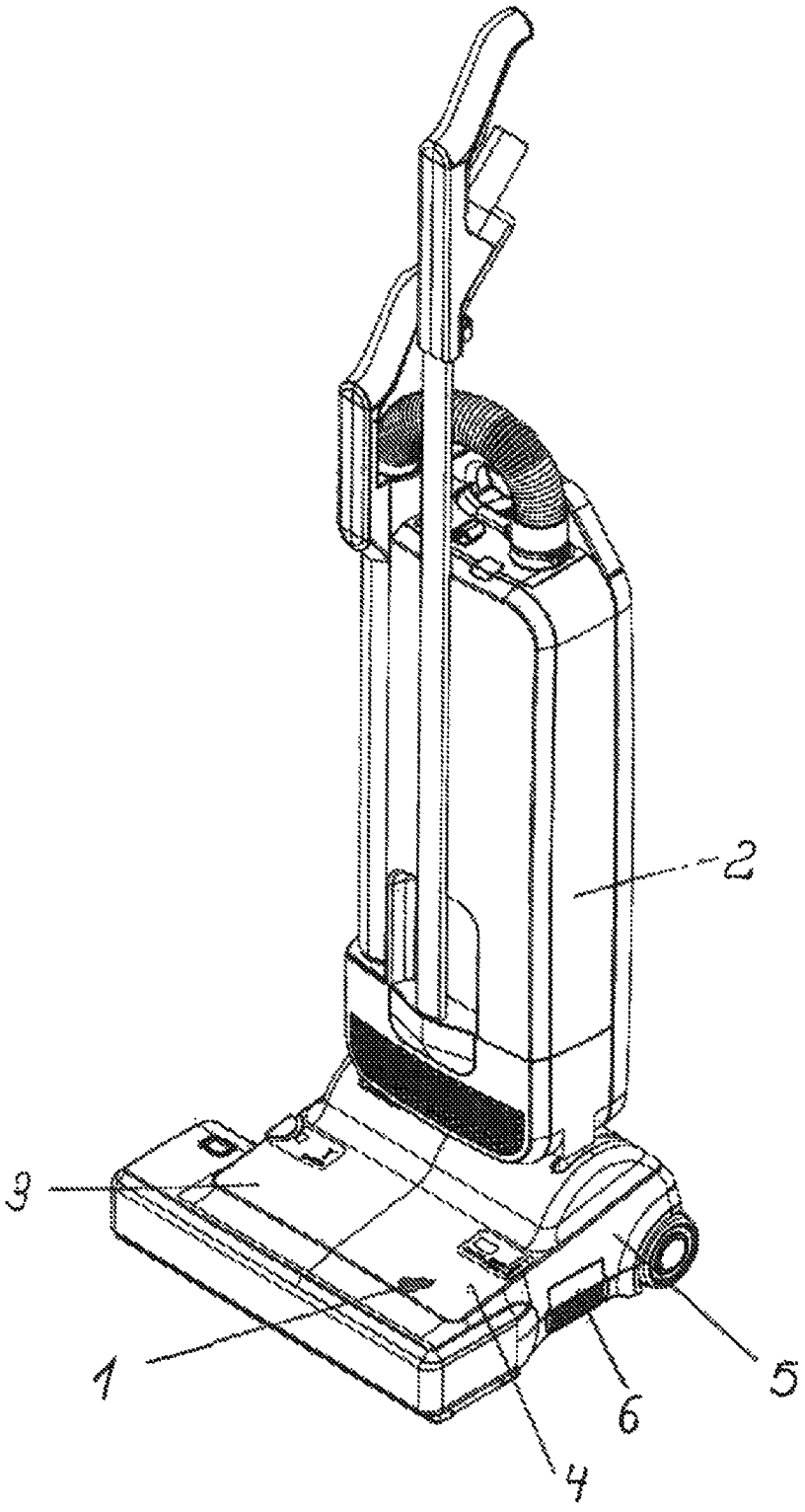
FIG. 1 shows a brush vacuum cleaner.
Figure 2:
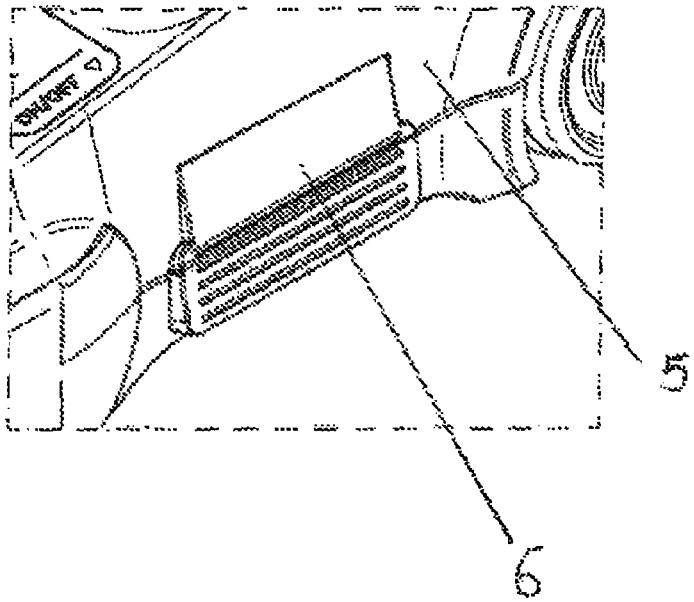
FIG. 2 shows an enlarged view of a control surface of a switch in the switched-off position as a lever surface hinged on one side.
Figure 3:
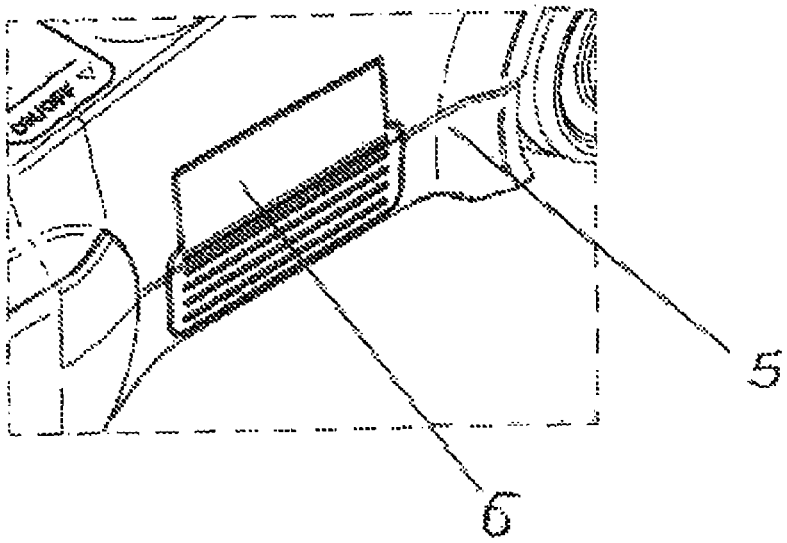
FIG. 3 shows a view as in FIG. 2 in the switched-on position.
Figure 4:
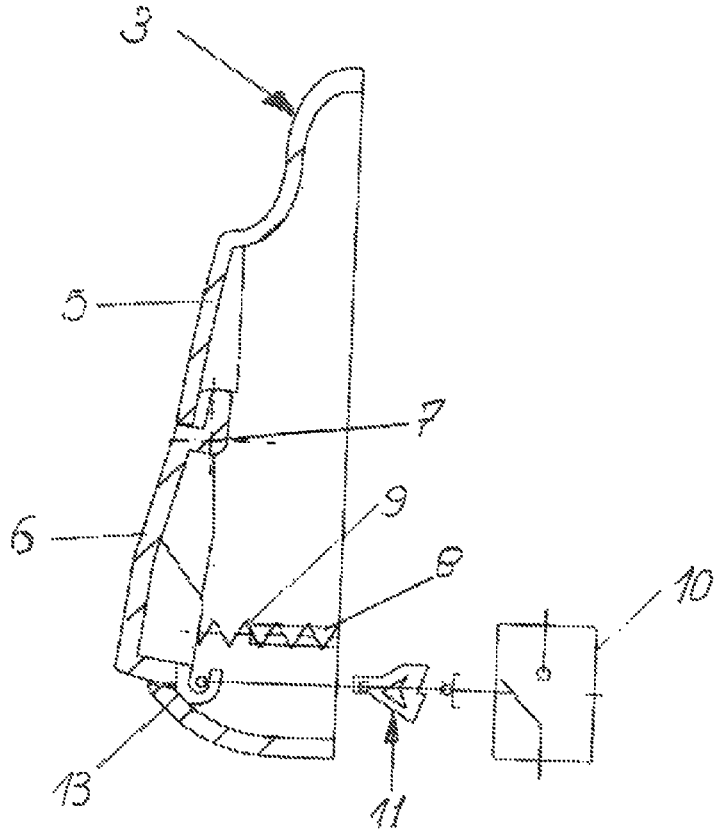
FIG. 4 shows a schematic diagram of a control surface of a switch in the switched-off position and FIG. 5 shows a diagram as in FIG. 4 in the switched-on position.
Figure 5:
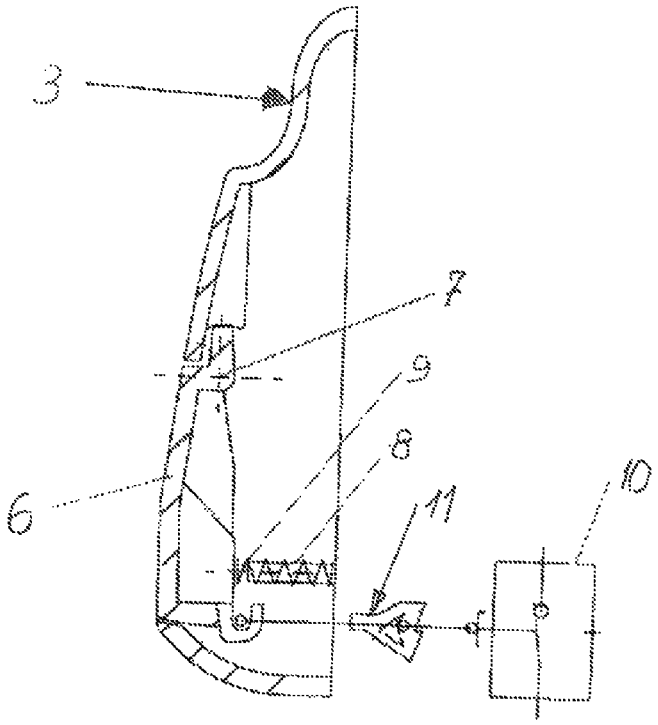

In the brush vacuum cleaner shown with a brush set 1 and a filter housing 2 with a hand grip, which can be attached by means of connecting pieces in the form of a pivotable connecting element, an electric motor for a suction fan and for driving a brush roller are provided in a known manner in the brush set 1.

A housing 3 of the brush set 1 is configured as a box shape and has an upper side 4 as well as substantially perpendicular side walls 5. A control surface 6 for foot operation of a switch 10 is provided on the left side wall 5 in the working direction of the brush set 1. The switch 10 is in this case coupled via a link circuit 11 to the control surface 6. The switch 10 can naturally also be disposed on the right side or at the back.

In this embodiment the control surface 6 is provided as a lever surface hinged on one side about a pivot point 7 of the housing 3 and has a stop 8 as well as an associated pressure spring 9. In the switched-on position of the switch 10, a flat positioning of the control surface 6 in the side wall 5 is accomplished via the link circuit 11 and a so-called push-to-open arrangement is created by the link circuit 11 which again sets the control surface 6 and the switch 10 in the switched-off position.

The control surface 6 is therefore integrated in the side wall 5 without overhang in the switched-on position whereas in the switched-off position the control surface 6 projects with respect to the side wall 5 and is held by means of a stop 13. In particular in the exemplary embodiment shown, in the switched-on position the control surface 6 ends flat with neighbouring or adjacent surface sections of the side wall 5.

Naturally these positionings of a control surface 6 in the individual positions can also be executed with a pressure switch.

In a brush vacuum cleaner having a brush set facing the floor for receiving a driven brush roller, wherein the brush set can be connected by means of a pivotable connecting element in the form of a connecting piece for an attachable filter housing to a handle in the form of a hand grip it is provided that the brush set accommodates an electric motor for a suction fan and for the drive of the brush roller. At the same time, an electrical switch is provided for switching on and off which is disposed on the side wall as a lateral flank of the brush set in the form of a foot operated switch. The switch with its external control surface projects outwards with respect to the side wall in the switched-off position whereas in the switched-on position the control surface ends with neighbouring or adjacent surface sections of the side wall without overhang.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a brush vacuum cleaner having a brush set facing the floor for receiving a driven brush roller, comprising:

a filter housing attachable to a handle having a hand grip via corresponding connections, the brush set being connected to the filter housing via a pivotable connecting element in the form of a connecting piece for an attachable filter housing to a handle in the form of a hand grip via corresponding connections and the brush set accommodating at least one electric motor for a suction fan and for the drive of the brush roller and having a switch for switching the motor on and off, a control surface for actuation of the switch being disposed on a side wall of the brush set as a lateral flank of the brush set, configured and arranged for foot operation, the external control surface projecting outwardly with respect to the side wall of the brush set in a switched-off position and in a switched-on position, the external control surface is positioned without any overhang relative to the side wall.

2. The floor care appliance according to claim 1, wherein the control surface of the switch is configured as a hinged lever surface which in the switched-off position projects at an angle with respect to the side wall of the brush set.

3. The floor care appliance according to claim 1, wherein the switch comprises a pressure switch.

4. The floor care appliance according to claim 1, wherein the control surface of the switch in the switched-on position is arranged flat in the surface of the side wall.

5. The floor care appliance according to claim 1, wherein the control surface of the switch is arranged on a left side of the brush set relative to a working direction of the brush set.

* * * * *